US009074760B2

(12) United States Patent
Dal Ben et al.

(10) Patent No.: US 9,074,760 B2
(45) Date of Patent: Jul. 7, 2015

(54) LAUNDRY MACHINE HAVING DRUM ILLUMINATION DEVICE

(75) Inventors: Diego Dal Ben, Zoppola (IT); Nicola Ius, Pordenone (IT); Luciano Saraceni, Osimo (IT); Maurizio Saraceni, Osimo (IT)

(73) Assignee: ELECTROLUX HOME PRODUCTS CORPORATION N.V, Brussels (BE)

( * ) Notice: Subject to any disclaimer, the term of this patent is extended or adjusted under 35 U.S.C. 154(b) by 118 days.

(21) Appl. No.: 13/988,876

(22) PCT Filed: Nov. 24, 2011

(86) PCT No.: PCT/EP2011/070881

§ 371 (c)(1),
(2), (4) Date: Aug. 9, 2013

(87) PCT Pub. No.: WO2012/072472

PCT Pub. Date: Jun. 7, 2012

(65) Prior Publication Data

US 2013/0314897 A1 Nov. 28, 2013

(30) Foreign Application Priority Data

Nov. 29, 2010 (EP) ..... 10192890

(51) Int. Cl.
*F21V 33/00* (2006.01)
*D06F 39/00* (2006.01)

(52) U.S. Cl.
CPC ..... *F21V 33/0044* (2013.01); *D06F 39/002* (2013.01)

(58) Field of Classification Search
CPC ..... F21V 33/0044; D06F 39/002
USPC ..... 362/89, 91, 234, 253; 63/3 R, 12.27
See application file for complete search history.

(56) References Cited

U.S. PATENT DOCUMENTS

2009/0153057 A1* 6/2009 Cho et al. ..... 315/76

FOREIGN PATENT DOCUMENTS

| | | | |
|---|---|---|---|
| CN | 201149207 | Y | 11/2008 |
| DE | 10316377 | B3 | 9/2004 |
| EP | 1582619 | A1 | 10/2005 |
| EP | 1918448 | A1 | 5/2008 |
| EP | 2113605 | A1 | 11/2009 |
| WO | 2007021082 | A2 | 2/2007 |
| WO | 2007058478 | A1 | 5/2007 |

OTHER PUBLICATIONS

International Search Report mailed Jan. 20, 2012 in corresponding International Application No. PCT/EP2011/070881.

* cited by examiner

*Primary Examiner* — Thomas M Sember
(74) *Attorney, Agent, or Firm* — Banner & Witcoff, Ltd.

(57) ABSTRACT

A laundry machine, in particular dryer, wash dryer or washing machine, includes: a body having a laundry loading opening; a drum, rotatably supported in the body; and a drum illumination device (10) for illuminating the interior of the drum. The drum illumination device (10) comprises a printed circuit board (PCB; 16) and at least one semiconductor or plasma light emitting element (19) arranged on the PCB (16), in particular at least one light emitting diode (LED).

19 Claims, 8 Drawing Sheets

LAUNDRY MACHINE HAVING DRUM ILLUMINATION DEVICE

BACKGROUND

The invention relates to a laundry machine having a drum illumination device for illuminating the interior of a laundry storing or receiving drum. The laundry treatment machine can be a dryer, a washer dryer, or a washing machine. The dryer can be a condensation dryer, a heat pump dryer, an exhaust or vented dryer or any type of dryer having a rotatable drum.

In prior art dryers normally a bulb lamp is arranged at a frame between the front rim of the rotating drum and the loading opening in the body of the dryer. The bulb lamp is covered by a cover glass that can be removed or opened for exchanging the bulb lamp. In the hot and humid environment of the dryer, the lifetime of the bulb lamp is limited. Under nowadays consideration also the high energy consumption of a bulb lamp for light generation cannot be neglected.

SUMMARY OF SELECTED INVENTIVE ASPECTS

It is an object of the invention to provide a drum illumination device in a laundry machine having a low energy consumption.

According to an aspect of the invention, a laundry machine for treating laundry therein has a body in which a rotatable drum is arranged. The laundry machine can be a washing machine, a washer dryer or any type of dryer with a rotatable drum. A drum illumination device is provided for illuminating the interior of the drum.

The drum illumination device comprises at least one semiconductor or plasma light emitting element which has or have reduced energy consumption as compared to a bulb lamp with the same light intensity emitted into the drum's interior. The light emitting element may be a light emitting diode (LED). The at least one light emitting element is arranged on a printed circuit board, wherein the printed circuit board provides a mechanical support for the at least one light emitting element and preferably electrical connections to the light emitting element. As normally the light emitting element is an electronic component that is sensitive to mechanical stress, providing the PCB as a support takes away the mechanical stress from the light emitting element and mounting of the at least one light emitting element is performed via mounting the PCB.

In the following, if reference is made to the "light emitting element", this includes one and only one light emitting element or two, three, four or more light emitting elements. "Light emitting element" also stands for one, two or more semiconductor or plasma light emitting elements.

According to a preferred embodiment, the PCB comprises a metal substrate, preferably an electrically conductive metal, more preferably an aluminum substrate. Using a metal substrate has the advantage that the PCB can be formed using metal processing techniques like cutting, punching, stamping, bending, curling and/or others. Thus, the form and shape of the metal substrate can be flexibly adapted according to constructive needs. In addition, metal substrates are superior in heat dissipation or conduction as compared to plastics or resin substrates, which means that heat generated by the light emitting element or being transferred from the drum interior to the drum illumination device is efficiently dissipated over the PCB for removal of the heat. For example, when the light emitting element is arranged close to the interior of the drum and at a front region of the PCB (where preferably the light emitting element is arranged), the PCB is extending away from the drum interior and heat generated at the front end of the PCB is dissipated to the backside of the PCB where heat exchange with the air surrounding the drum may take place. Also the metal substrate itself can be used, if electrically conductive, as one (e.g. single-phase or voltage) conductor convenient to provide electrical connection to the light emitting element or other electronic components that may be arranged on the PCB.

In an embodiment one or both sides of the metal substrate is or are at least partially covered by an electrically insulating layer wherein at least one conductive trace or path is formed on the one insulating layer or on one or both of the insulating layers. The insulating layer may be for example a resin layer, a plastic layer, a dielectric layer and it may be formed by (screen) printing, spinning, sputtering, (chemically) depositing or the like. By providing the electrically insulating layer on the metal substrate, the at least one electrically conductive trace or path can be formed on the insulating layer without electrical contact between the metal substrate and the conductive trace. The conductive trace can for example provide electrical power or signal(s) to the light emitting element and/or any other electric or electronic component arranged on the metal substrate (PCB). The conductive trace may be formed as in conventional PCBs by screen printing or depositing a metal layer on the insulating layer and then structuring the metal layer to form the one or more conductive traces.

The light emitting element and/or any other electronic or electrical component may be connected to the at least one conductive trace for example via soldering or brazing, using any of the conventional techniques. And/or the light emitting element may be placed on the insulating layer or directly on the metal substrate, wherein in the latter case preferably at least a portion the light emitting element body or a contact thereof is electrically connected to the metal substrate. As mentioned above, for providing two electrical connections, one conductive trace is sufficient as the metal substrate can be used as a separate electrical connection. Preferably, the at least one conductive trace electrically connects the light emitting element placed at one position of the metal substrate to a terminal or connector section of the PCB.

In an embodiment, a housing of the light emitting element is directly placed on the PCB. Alternatively, the light emitting element itself can be arranged on a separate PCB or substrate and additional electronic components may be provided on the separate PCB or substrate. Of course, the separate PCB or substrate is smaller than the PCB of the drum illumination device, for example it is maximally or less than one third, one fourth, one fifth or one tenth of the surface area of the PCB of the drum illumination device.

In a preferred embodiment, the PCB is non-planar, wherein preferably a base portion of the PCB and an inclined portion thereof are inclined relative to each other. By inclining one portion of the PCB relative to the other, the total mounting depth in the direction from the base portion to the inclined portion is reduced as compared to a PCB where the base portion and the inclined portion are not inclined, i.e. when forming a planar substrate. In particular when the light emitting element is mounted on the inclined portion, the emission direction of the light emitting element is conveniently adapted to the local requirements relating to the mounting position for the drum illumination device and the center of the rotatable drum. If for example the mounting direction and main longitudinal extension of the drum illumination device is parallel or perpendicular to the rotation axis of the drum and due to the requirement that the drum illumination device cannot be arranged in a manner blocking the drum opening, by bending the inclined portion relative to the base portion, the illumination direction or light cone of the illuminating device can be pointed towards the center of the drum. Thereby, no separate inclined mounting elements are required and by mounting the base portion according to mounting requirements, the direction of light illumination can be set independent of the mounting configuration and without additional mechanical elements. Thus, just mounting the PCB (as provided in the housing of the drum illumination device) results in an optimized illumination angle towards the drum interior.

According to an embodiment, the PCB comprises a connector section at a base portion of the PCB such that providing an electrical connection for example by a pluggable connector is made by connecting the base portion of the PCB. Thus the light emitting element is not directly contacted, and providing a connection or disconnecting is free of mechanical stress to the light emitting element. Preferably, a connector section is provided at a section of the base portion opposite to the inclined portion where the light emitting element is arranged, whereby the electrical connection section to a connector is spatially separated from the inclined portion and the connection procedure and configuration can be provided independent of the light illumination direction.

Preferably, the PCB is mounted in a supporting body of the drum illumination device such that the PCB is mechanically stabilized by the supporting body. The PCB may be snap-fitted, glued, soldered, screwed or fixed in any other way in the supporting body. Preferably in the manufacturing step of the supporting body the PCB is at least partially integrally cast or over-injected to the PCB. By over-injecting or integrally casting no separate mounting step is required for mounting the PCB on or in the supporting body.

In an embodiment, the supporting body acts not only for mechanically supporting the PCB, but also provides a support structure for joining or assembling the drum illumination device (i.e. it acts like a chassis for receiving and inter-connecting other parts of the drum illumination device). For this the supporting body may comprise snap-fitting means or mounting means adapted to mount or snap-fit an optic case element and/or an electrical connector.

According to an embodiment, the drum illumination device comprises an optic case element adapted to cover the light emitting element and also preferably to receive at least a portion of the PCB and/or the supporting body. The optic case element comprises an optical window that is facing or is close to the light emitting element and adapted to transmit the light emitted by the light emitting element to the outside of the drum illumination device. The optical window closes and protects the light emitting element versus the processing conditions in the drum. For example, in a washing machine washing liquid, heat, steam and laundry are prevented to directly come in contact with the light emitting element. In a dryer, hot air and humidity as well as the rotating laundry are prevented from contacting the light emitting element. Advantageously, when the optic case element also covers at least a portion of the PCB, a front shielding element is provided by the optic case element that in addition to the optical window also shields at least a portion of the PCB and/or the supporting body from the interior conditions of the drum.

Preferably, in the optic case element not only the optical window is transparent, but the material is formed from a single material as a monolithic or integral part so that no separate manufacturing or mounting steps are required for providing the optic case element. Alternatively or additionally, the (front and rear) surfaces of the optical window are parallel or substantially parallel to each other. In further alternative or additional configurations the optical window is parallel or essentially parallel to the inclined portion of the PCB and/or the optical window is inclined with respect to the longitudinal axis of a base portion of the PCB (for example as mentioned before). Thereby, the light is transmitted towards the center of the drum's interior in a most efficient way. Also, as mentioned before, inclining of the optical window and/or light emitting element enables a mounting configuration and design of the drum illumination device which is at least partially independent of the direction required for optimally illuminating the interior of the drum.

As an example for the inclination of the optical window and/or the inclined portion of the PCB—wherein the inclination angle is measured between the surface of the optical window or the inclined portion relative to the surface of the base portion of the PCB—the inclination angle is in the range of 20 to 90°, preferably in the range from 30 to 90°, 40 to 80°, 60 to 80° or about 70°. Preferably the inclination angle of the optical window and the inclined portion of PCB are or are substantially the same or within a deviation of ±10°, preferably ±5° or ±3°.

Preferably, the optic case element comprises internal mounting means adapted to cooperate with mounting means of the supporting body to provide a mechanical connection between the optic case element and the supporting body. Preferably, the internal mounting means are snap-fitting elements mating with respective snap-fitting elements provided at the supporting body to simplify the mounting process in that just a snap-fit has to be established. Additionally or alternatively, the optic case element comprises external mounting means adapted to cooperate with a receiving mount arranged in proximity to the drum and having an opening facing towards the drum interior. "Internal" mounting means refers to a mechanical connection among the physical elements or components of the drum illumination device itself. In contrast thereto, "external" mounting means refers to mounting means adapted to mount the drum illumination device on another component of the laundry machine which is not the drum illumination device itself. For example, the receiving mount. Preferably, the external mounting means is also a form-fit or snap-fit connecting element such that during mounting, the optic case element just has to be snap-fitted or pressed into the receiving mount having correspondingly cooperating snap-fitting or form-fitting elements or configurations.

Advantageously, the receiving mount is a mounting structure adapted to receive the finally assembled or pre-assembled drum illumination device such that the drum illumination device is arranged in proximity to the drum. The receiving mount has an opening that is facing towards the drum interior or is an opening in communication with the drum interior such that through this opening the drum illumination device can emit the light towards the interior of the drum.

Preferably, a sealing element is arranged or provided at the optic case element, wherein the sealing element is adapted to provide a sealing between the optic case element and a or the receiving mount for receiving the drum illumination device. Depending on the type of laundry machine, the sealing element provides a sealing between the drum illumination device and receiving mount to retain air, humidity and/or water within the interior space of the drum. In an embodiment, the sealing element advantageously has a sleeve section that is at least partially surrounding the outer surface of the optic case element and/or wherein the sealing element is integrally cast or over-injected to the outer surface of the optic case element. For example, the sealing element and the optic case element may be mold-injected in one molding step using two different molding components or materials ("two-component" injecting or molding). Preferably, a soft elastic material is used for the sealing element while a hard and (preferably) optically transparent material is used for the optic case element.

According to an embodiment, the illumination device, preferably the optic case element and/or a sealing element of the illumination device, comprises or comprise at least one alignment element, by which the drum illumination device is aligned to a predetermined position in a receiving mount for receiving the drum illumination device. Thus, the mounting procedure is facilitated in that the drum illumination device can be mounted in the receiving mount only in a predefined position. Particularly, when the PCB is bent and has a base portion and an inclined portion, the illumination direction of the light emitting device is automatically adjusted by position alignment. Preferably, the receiving mount comprises a counter-alignment element which cooperates with the one or more alignment elements of the illumination device in a mating manner.

Alternatively or additionally, the drum illumination device, preferably the optic case element and/or the or a sealing element, comprises a fixing element adapted to fix the drum illumination device in a predetermined position in a receiving mount. In addition or in combination with the above mentioned alignment element, the fixing means mechanically fixes the drum illumination device in the receiving mount. Preferably snap-fitting elements are used as a fixing means such that the drum illumination device is securely mounted in the receiving mount. For example, the at least one alignment element provides a rotational or angular alignment during mounting of the drum illumination device, while the fixing means provides a longitudinal fixation of the drum illumination device in the receiving mount such that e.g. the front surface of the drum illumination device is flush to a surrounding surface of the receiving mount.

Preferably, the receiving mount is arranged at or in the or a frame, preferably is part of the frame, which is arranged between the front end at the front opening of the drum and a laundry loading opening. Preferably, the laundry loading opening itself is also at least partially defined by the frame.

In an additional or alternative arrangement, the receiving mount is a through-hole through the frame and the drum illumination device is inserted from the front side, which is facing to the interior of the drum, or from the rear side into the hole, wherein the drum illumination device is preferably inserted from the front side into the through-hole forming the receiving mount and an electrical connector is connected to the drum illumination device from the rear side of the frame.

In an embodiment that is useful for washing machines or washer dryers the frame is or comprises a gasket, preferably a gasket that is connecting and sealing the space between a laundry loading door and a tub of the washing machine. The receiving mount may be provided by a hose section extending from the gasket and into which the drum illumination device is inserted from outside or inside (wherein inside refers to the side communicating with the drum interior).

Preferably, when the drum illumination device is mounted in the receiving mount, the front face of the drum illumination device is designed in a flush or in an essentially flush manner with a surface area at the inner side of the frame that is surrounding the front face of the drum illumination device. Thus, during agitation of the laundry, the laundry can slide in a soft and uninterrupted manner along the flush inner surface that is not disturbed by the drum illumination device. The mechanical load and wear to the front of the drum illumination device is reduced thereby. Preferably, the front face of the illumination device that is facing to the interior of the drum is formed by the or an optical window of the drum illumination device.

Preferably and for facilitating the mounting and constructional procedure of the laundry machine, the mounting axis or longitudinal axis of the drum illumination device is arranged horizontally or vertically with respect to the laundry machine body and/or parallel or perpendicular to the drum rotation axis.

BRIEF DESCRIPTION OF THE DRAWINGS

Reference is made in detail to a preferred embodiment of the invention, which is illustrated in the following figures, which show.

DETAILED DESCRIPTION OF EXAMPLE EMBODIMENTS

Figure 1:
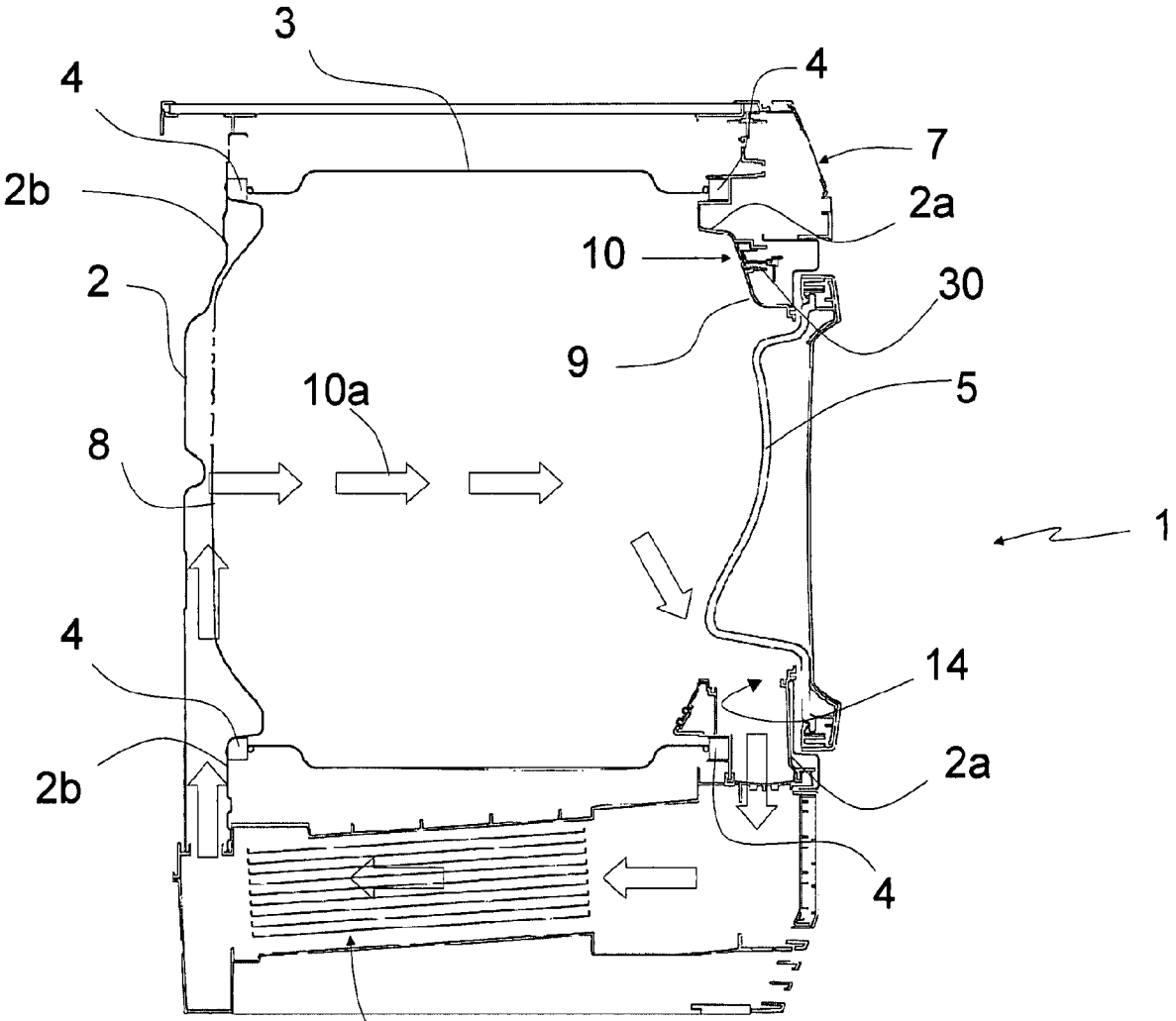
FIG. 1 a schematic cross-section through a condenser-type dryer.

FIG. 1 shows a schematic side-view cross-section of a condensation dryer having a LED lamp 10. The condensation dryer is an exemplary embodiment for a laundry machine where the LED lamp 10 can be used. It is also applicable in a washing machine, a washer dryer, a heat pump type dryer, a ventilation dryer or any other type of dryer.

Figure 2:
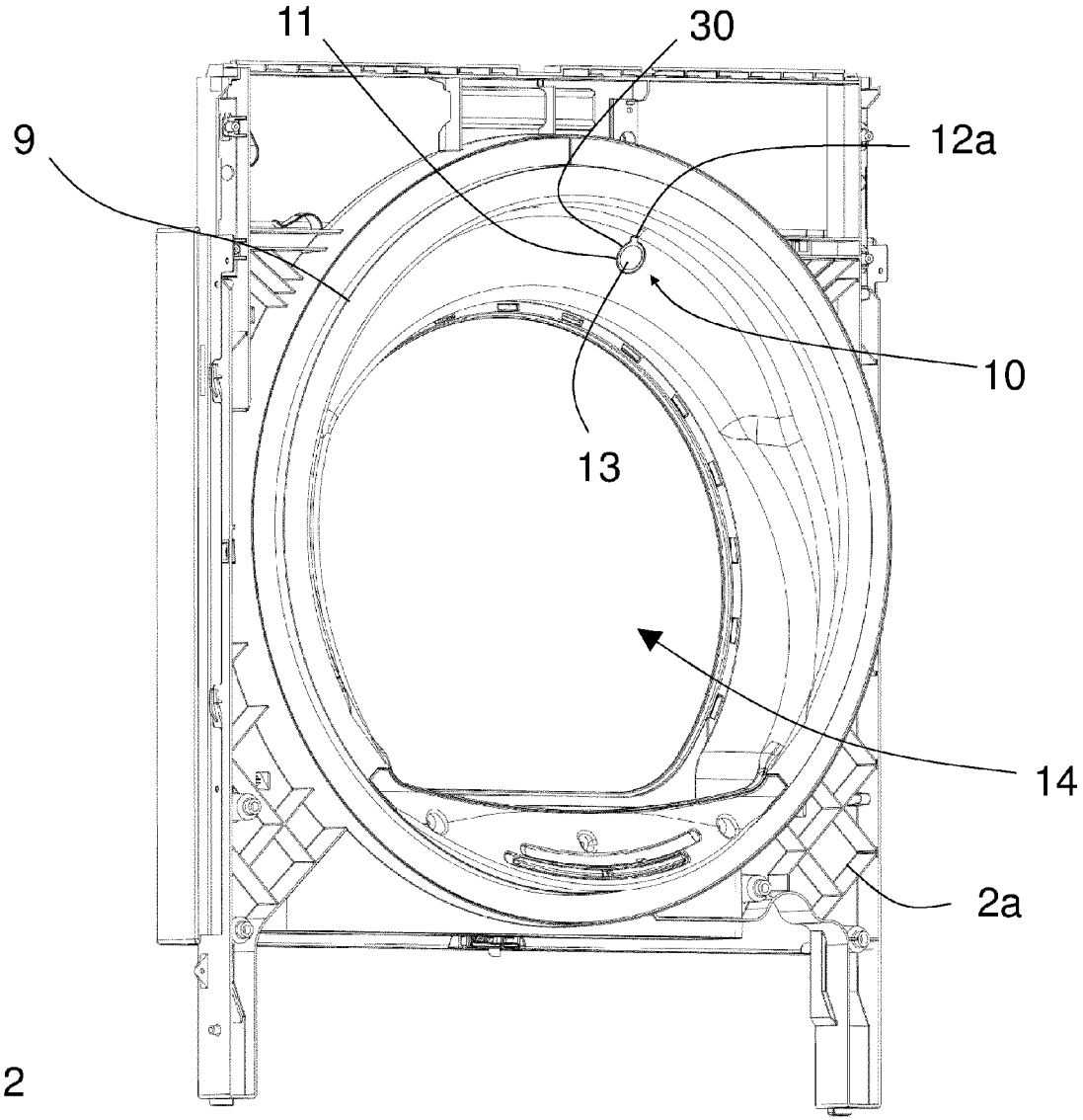
FIG. 2 a drawing showing the rear side of a front wall of the dryer shown in FIG. 1, wherein the front air entrance grill and the loading door are omitted, FIG. 3 an exploded perspective view of a LED lamp, FIG. 4 a partially assembled state of the components of the LED lamp shown in FIG. 3, FIG. 5 the LED lamp of FIG. 3 in a fully assembled state with a plug connector disconnected, FIG. 6 the LED lamp with the plug connector connected, FIG. 7 a front view of the assembled and connected LED lamp, and FIG. 8 a cross-section along lines VIII-VIII in FIG. 7 through the fully assembled and connected LED lamp.

The dryer 1 has a body 2 or housing, wherein the front section of the body 2 is formed by a front structure 2*a* which is shown from the rear side (i.e. the inner side of the washing machine) in FIG. 2. With respect to FIG. 1, the outer surface of front structure 2*a* is when looking from the right side to the front of the washing machine and the rear side of the front structure 2*a* is facing to the interior of body 2 when looking from the left side to the front structure 2*a*. In the interior of the body 2 a drum 3 is rotatable supported between the front structure 2*a* and a rear structure 2*b*. The front opening rim and the rear opening rim of the drum 3 are advantageously abutting against gaskets 4 which are preferably supported in circular grooves respectively formed at the front structure 2*a* and the rear structure 2*b*.

The front structure 2*a* has preferably a frame or flange 9, which advantageously extends between the gasket 4 or the groove receiving the gasket 4 of the front structure 2*a* and a loading opening 14 formed in the front structure 2*a*. During operation of the dryer 1, the loading opening 14 (which is of course a loading/unloading opening) is closed by a front door 5 which in turn is preferably pivotably mounted on the outer surface of the front structure 2*a*. Further, during operation the air is circulated through an air channel, in which a condenser 6 is preferably arranged, and the interior of drum 3 as indicated by the arrows representing the airflow 10*a*. The air is heated by a heater (not shown) wherein any type of heater may be used. In case of a heat pump dryer the air is heated by the condenser heat exchanger of the heat pump system and possibly by an additional heater.

A control panel 7 is located preferably on the upper outer front structure 2*a* where the control elements and control indicators for program selection and program sequence indication by and for a user are preferably arranged. The rear structure 2*b* has on its inner side a rear cover 8 covering the rear opening of the drum 3, preferably between the rear circular gasket 4. Openings are formed in the rear cover 8 for introducing the air flown into the interior of the drum. The air flow 10*a* is circulated for example by a blower which is not shown.

A LED lamp 10 is arranged at an upper portion of the frame 9 in which a receiving mount or lamp socket 30 for receiving the lamp 10 is formed. The front face of the lamp 10 which is provided by an optical window 13 is preferably flush with the surrounding surface of the frame 9.

FIG. 2 shows the rear or inner side of the front structure 2*a* of the washing machine body 2. The frame 9 surrounding the loading opening 14 and extending from the loading opening 14 to the groove receiving the front gasket 4 is shown in more detail. The lamp 10 is mounted in the lamp socket 30. The optical window 13 can be seen in a perspective when looking from the inside of the drum towards the frame 9, wherein the optical window surface is preferably surrounded by the front face of an elastic sleeve 11 which is shown in more detail in FIG. 3. The surface of the optical window 13 as well as the front face of the elastic sleeve 11 are advantageously mutually flush such that the laundry that is rotated by the drum rotation and is sliding over the frame 9, the front face of elastic sleeve 11, and optical window 13, is not undergoing deflections that would be caused by a step or swell at the surface. Taking other way round: the surfaces of the window 13 and the sleeve 11 are not damaged by the laundry, for example a knob or zip of a trouser during rotation of the drum.

Figure 3:
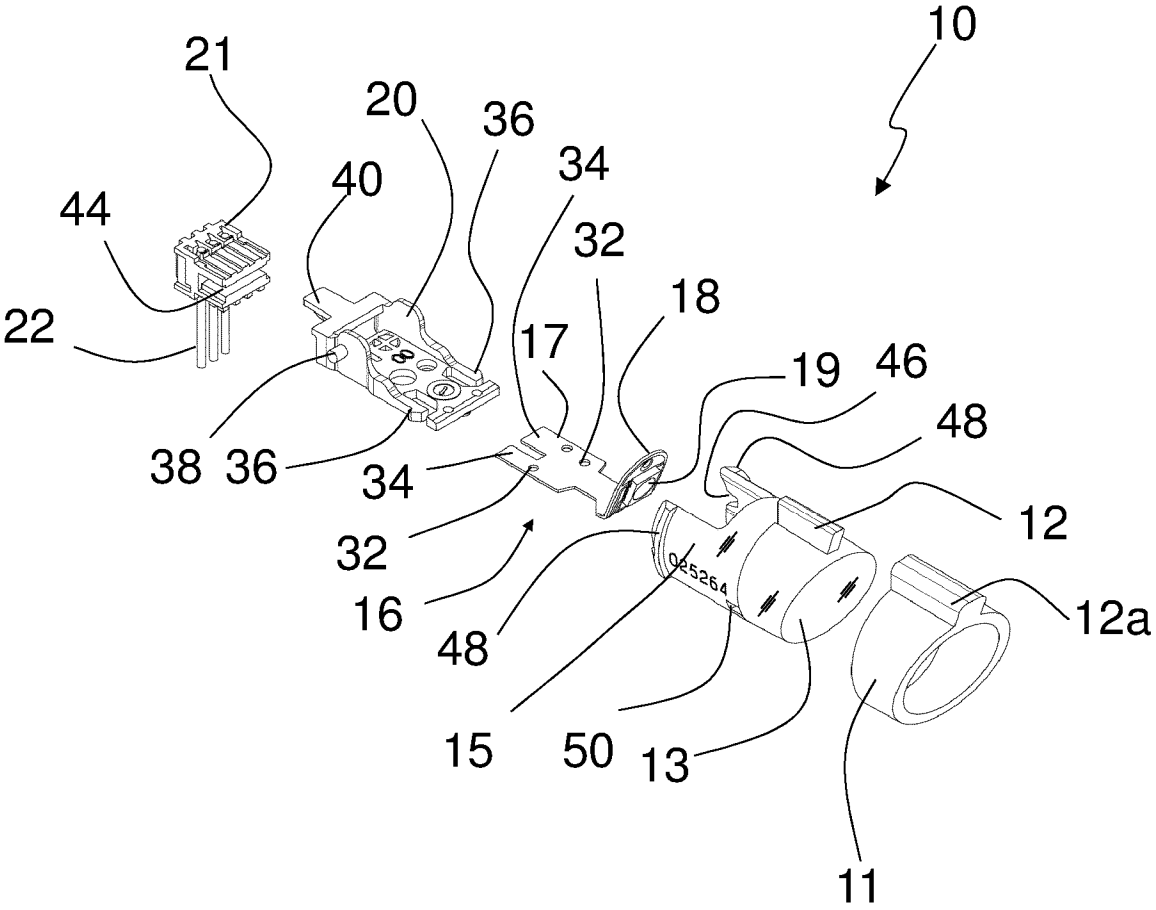

FIG. 3 shows an exploded perspective view of the LED lamp 10. The lamp 10 has a LED component 19 (LED=Light Emitting Diode) which is advantageously formed by a SMD component (SMD=Surface Mounted Device). At the component 19 preferably one or more LEDs are arranged on the top surface of a substrate which is surface mounted and electrically connected to a PCB board 16 (PCB=Printed Circuit Board). The PCB 16 preferably comprises a base plate 17 and a cantilever plate 18 which is inclined relative to the base plate 17. The LED component 19 is mounted on the section of the cantilever plate 18 such that by correspondingly adjusting the tilt angle $\alpha$ (FIG. 8) between base plate 17 and cantilever plate 18, the illumination direction of the light emitted by the LED is set to a predetermined angle.

The substrate of the PCB 16 is a plate made advantageously of metal, preferably an electrically conductive metal, more preferably aluminum, which is advantageously cut, punched and bent in a metal plate processing procedure. Thereby vias 32 are preferably formed in the aluminum substrate and tongues 34 preferably extend at the rear or end edge of the base plate 17 which is located opposite to the cantilever plate 18. At least one of the surfaces of the metal plate is advantageously over-coated by an insulating layer. In the embodiment illustrated in the enclosed figures, the bottom surface of the substrate is over-coated by an insulating layer wherein the bottom side of the PCB or substrate is the side of the base plate 17 which is hidden in FIG. 3 and which continues at the cantilever plate 18 such that it is seen in FIG. 3 (the side where the LED component 19 is arranged).

On the insulating layer, electrical contact traces or paths 52 (partially shown in FIG. 4) are preferably formed to provide electrical connections between contact terminals, advantageously provided at the lower side of the tongues 34, at SMD components 62 (FIG. 8) preferably arranged on the bottom side of base plate 17 and at the LED component 19 arranged preferably on the bottom side of the cantilever plate 18.

Advantageously, the PCB 16 is mechanically supported by a chassis 20 which is preferably made of plastics and is preferably, but not necessarily, over-injected to the PCB. This means that after pre-manufacturing the PCB 16, the PCB is advantageously inserted in a die cast or molding tool and the chassis 20 is formed around the PCB such as to receive and mechanically support the PCB. As shown in the cross-section of FIG. 8, the injected plastics advantageously partially flows through the vias 32 of the PCB 16 and forms mold knobs or heads on the other side of the vias which act as a fixing means mechanically connecting the PCB 16 and the chassis 20. Therein the mold knob 60 is made of the plastics material injected for forming the chassis 20.

The chassis 20 preferably has snap hooks 36, advantageously at the lateral front sides, which during the mounting process snap into cut-outs 50 formed in a lamp case 15. Preferably, at the lateral rear sections the chassis 20 has alignment pins 38 which during the mounting process are inserted into grooves 46 formed at the lateral end or rear sides of the lamp case 15. This means that during the mounting process the chassis 20 having mounted thereon the PCB 16 is inserted from the open rear side into the inner space of the lamp case 15 until the snap hooks 36 snap into and engage with the cut-outs 50 while at the same time the alignment pins 38 are placed in the grooves 46. Thereby the chassis 20 is fixed and aligned within the lamp case 15. Clearly the chassis may have any other shape, and it can be fixed to the lamp case 15 also in other ways, for example by welding, by gluing, etc.

Figure 8:
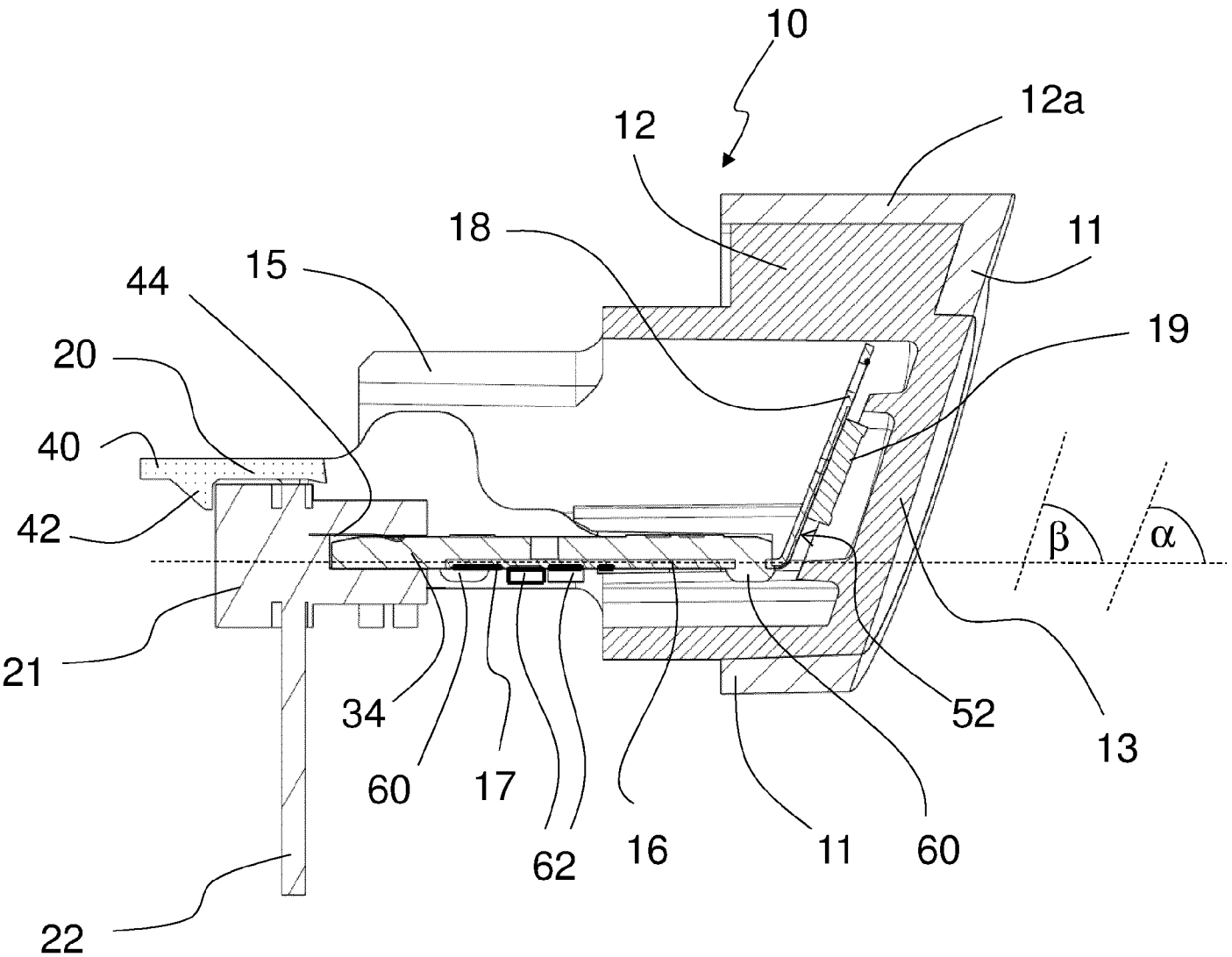

Extending from the rear edge of the chassis 20 a guide lug 40 is preferably provided, which may advantageously have on its lower side a latch hook 42 as can be best seen from cross section in FIG. 8. When a coupler plug 21 is plugged onto the tongues 34 extending from the rear of the PCB 16 and supported by the rear section of chassis 20, the guide lug 40 is elastically deflected until the latch hook 42 passes the rear edge of the coupler plug and secures the plug 21 in its plugged position. Preferably, the plug 21 has a slot 44 which receives the two tongues 34 between its brackets. Preferably, the tongues 34 of the PCB 16 overlap with a rear section of the chassis 20 so that the tongues are mechanically supported. The cross section of FIG. 8 shows the rear section of chassis 20 clamped in the slot 44 while the tongues, which are extending into the slot 44 at the lower side of the PCB 16, can not be seen in this view. Electric contacts are preferably provided in the slot 44 which contact to the two traces 52 each one advantageously provided on one of the tongues 34, and also an electric contact in the slot 44 advantageously provides electrical contact to the metal substrate of the PCB. Preferably the metal substrate provides ground potential or one electrical phase to LED component 19 and/or components 62. Advantageously three insulated wires 22 are electrically connected to the electrical contacts in the slot 44 of the plug 21. In the mounting process, when the plug 21 is inserted over the tongues 34, electrical connection is provided to a control and power unit of the dryer (not shown) via the wires 22.

At the lateral front section of the lamp case 15 a projection 12 is preferably provided, which serves as an angular alignment means and is radially extending from case 15. During mounting of the lamp 10 in the lamp socket 30 of the frame 9, the projection 12 (actually the nose 12*a* of sleeve 11—see below) allows only one angular orientation of the lamp 10 with respect to the frame. The lamp case 15 is advantageously made at least partially of an optically transparent material, for example plastic mold-injected, with the optical window 13 at its front end. Preferably the case 15 also has lateral cut-outs 50 (shown in FIG. 3) for receiving the snap hooks 36 at its lateral sides and has grooves 46 at the rear edge for receiving the alignment pins 38.

Preferably, the rear edge of the lamp case 15 is laterally (radially) extended by collars 48 provided preferably on both sides. The rear section of the lamp case 15 is preferably designed as two elastically deflectable claws or brackets (elastically deflectable within restricted tolerance). When the lamp case 15 is inserted into the lamp socket 30 from the inner side of the frame 9 during the mounting process, the brackets having the collars 48 are slightly pressed together, the collars 48 slide through the hole of the lamp socket 30 and spread at the end edge of the hole such as to snap to the outer hole edge and to mechanically fix the lamp case 15 and thus the lamp 10 at a predefined longitudinal or depth position in the lamp socket 30.

The elastic sleeve 11 advantageously laterally surrounds the front section of the lamp case 15, preferably including the projection 12. The projection 12 including its front edge pointing towards the drum interior in the mounted state is covered by the nose 12*a* of the sleeve. The elastic sleeve 11 advantageously compensates a dimensional tolerance between the outer surface of the lamp case 15 in the front area and an inner surface of the hole of the lamp socket 30 into which the lamp 10 is inserted. Preferably, the sleeve 11 is so shaped that, when inserting the lamp 10 into socket 30, the sleeve 11 is slightly elastically compressed such that a sealing function is provided between the outer surface of the case 15 and the inner surface of the lamp socket 30. Thus the elastic sleeve 11 seals the opening against hot air, humidity and/or water that might escape from the interior of the drum 3. Preferably the sleeve 11 is over-injected onto the front area of the lamp case 15, without covering or obstructing the optical window 13. In case that the sleeve is over-injected onto the lamp case 15, the separated illustration of the sleeve 11 and case 15 in FIG. 3 is shown only for illustrative purposes.

Figure 4:
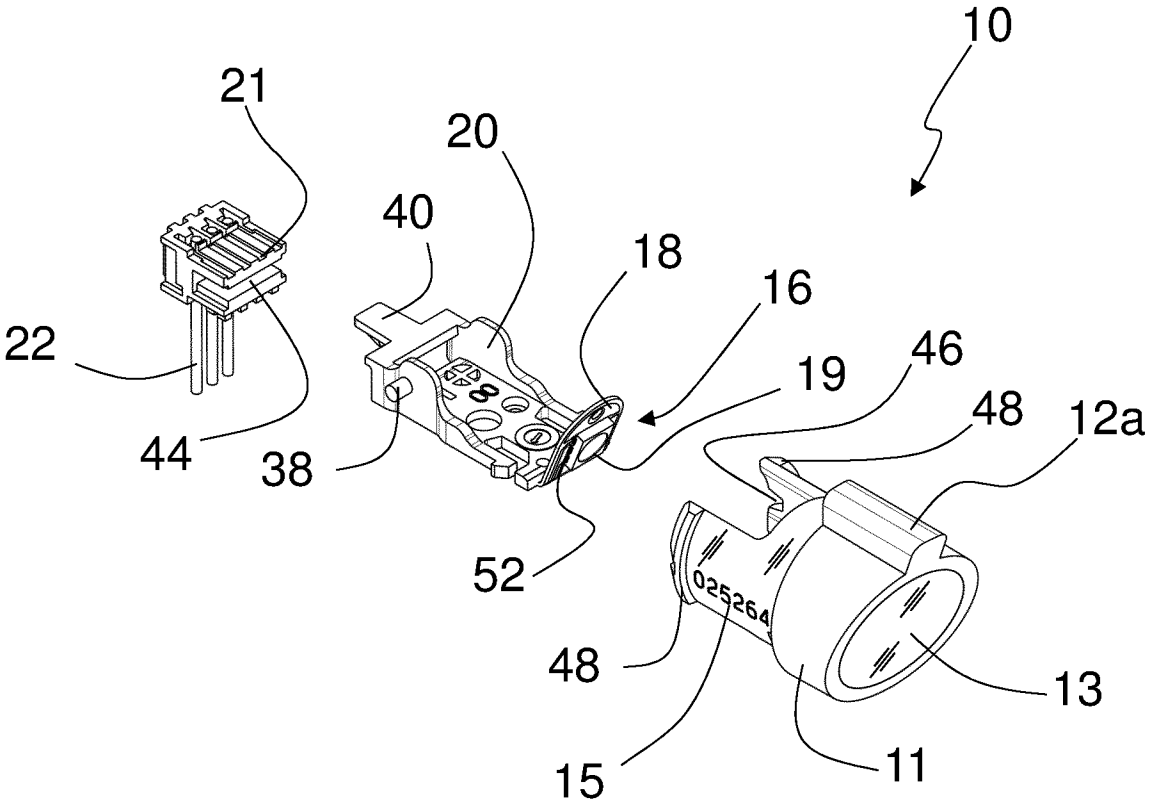

FIG. 4 shows a partially exploded perspective view of the lamp 10. As compared to FIG. 3, the plastic sleeve 11 is now mounted around the front section of lamp case 15. Further as compared to FIG. 3, the PCB 16 is arranged in the chassis 20. Again, in case that the chassis 20 is over-injected to the PCB 16, the separation of the components 16 and 20 is shown in FIG. 3 only for illustrative purposes.

Figure 5:
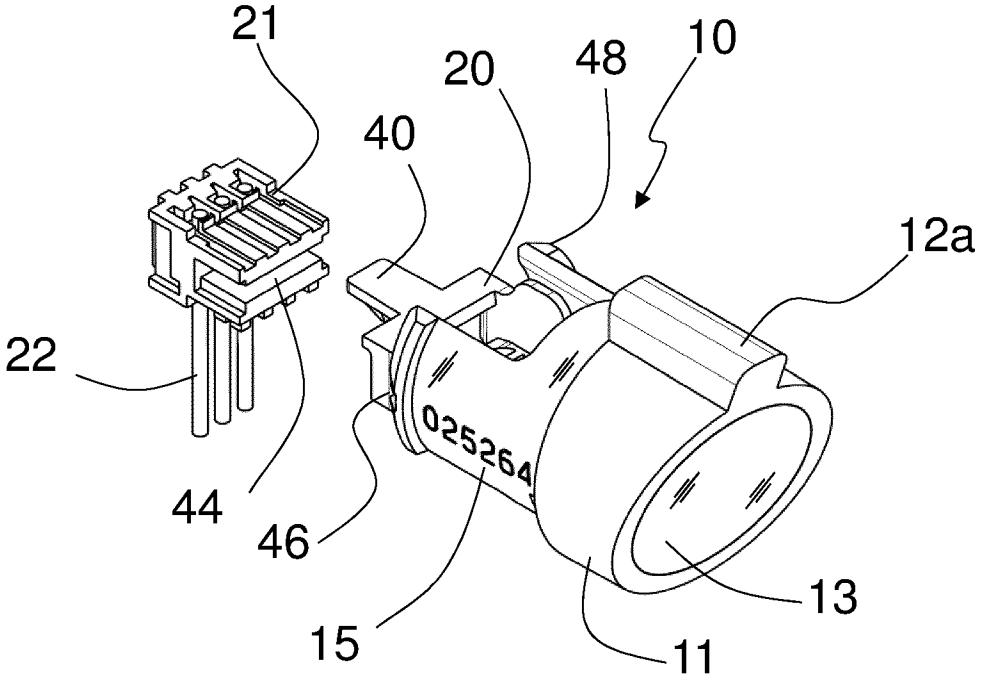

FIG. 5 shows the lamp 10 fully assembled, wherein the snap hooks 36 are engaged with the cut-outs 50 and the alignment pins 38 are inserted into grooves 46. The tongues 34 on the rear edge of chassis 20 and the guide lug 40 extend from the rear end of the lamp 10.

Figure 6:
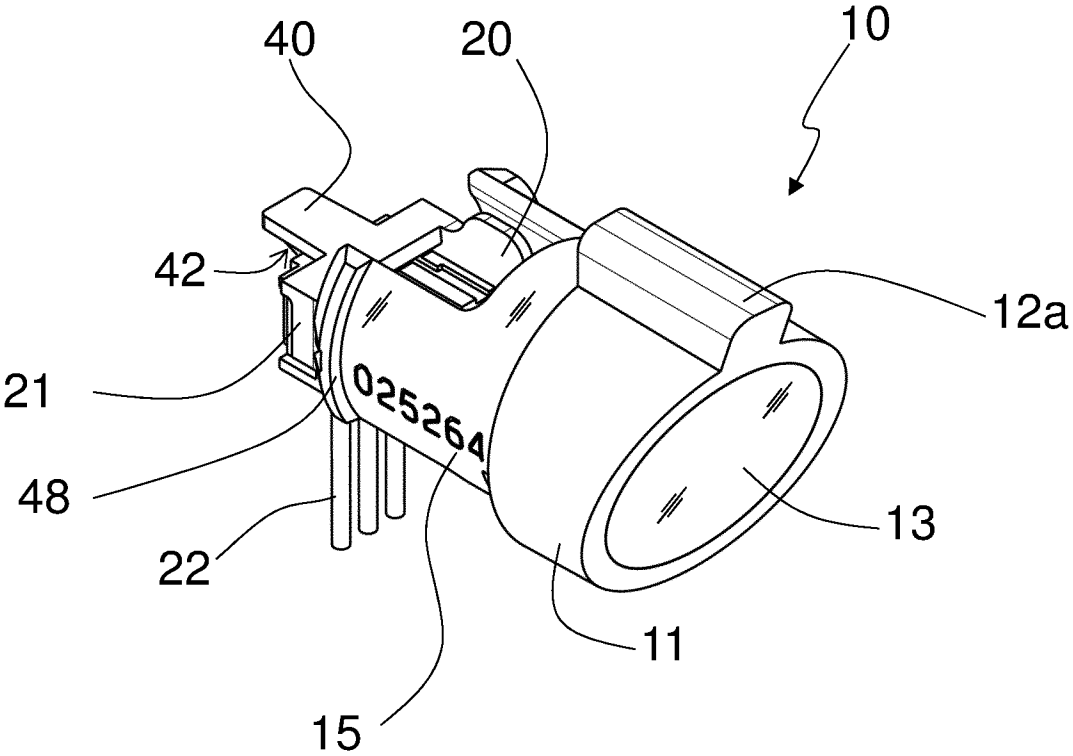

FIG. 6 shows a perspective view of lamp 10 after connecting plug 21 to the tongues 34 on the rear edge of chassis 20 and shows the engagement of latch hook 42 of the guide lug 40 with the rear edge of the plug 21.

Figure 7:
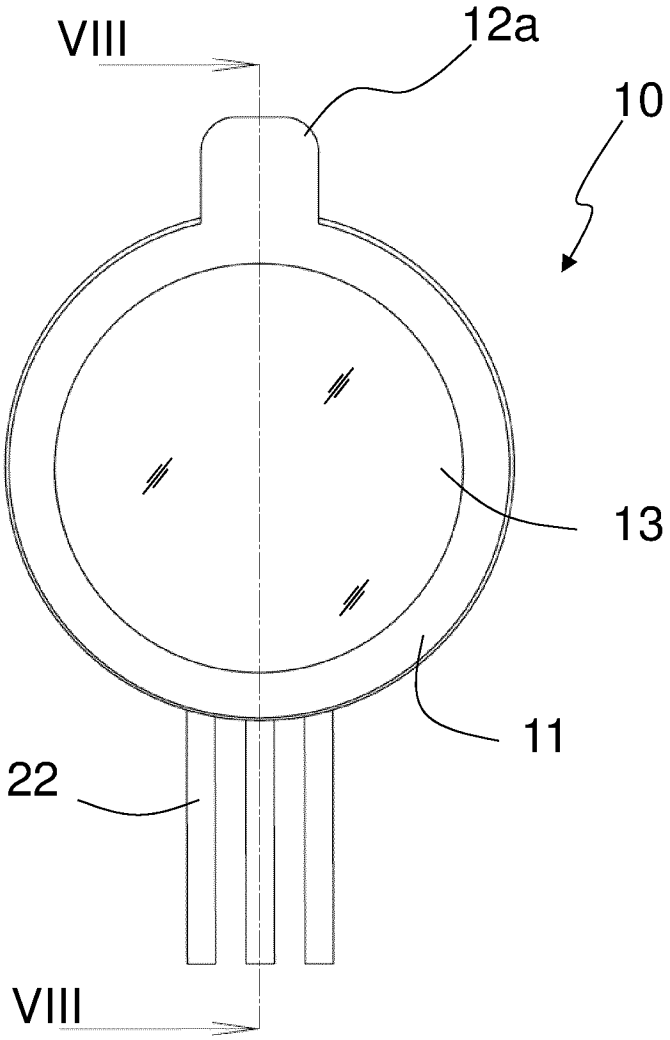

FIG. 7 shows a front view of lamp 10 with the plug 21 connected at the rear side. Section line VIII-VIII as shown in FIG. 7 indicates the plane of the cross section shown in FIG. 8.

FIG. 8 shows the cross section of the lamp 10 and the plug 21. Here the angular relationship between the base plate 17 and the cantilever plate 18 are indicated by angles α and β. α is the angle between the longitudinal axis of base plate 17 and the cantilever plate 18 (which is preferably, but not necessarily, around 70°), while β is the angle between the base plate 17 and the optical window 13 (which is preferably, but not necessarily, around 73°). By providing the tilt angle α, the LED component 19 is emitting its light beam or light cone towards the center of the drum for optimum illumination. The surface angle β is defined such as to minimize any steps or unevenness between the outer surface of the optical window 13 and/or front edge of sleeve 11 in the region of the lamp socket 30. Thereby the lamp front surface is flush with the surrounding surface of frame 9 in the area of the lamp socket 30. Clearly α and β may also be equal one another.

| Reference Numeral List: | |
|---|---|
| 1 | condensation dryer |
| 2 | body |
| 2a | front structure |
| 2b | rear structure |
| 3 | drum |
| 4 | gasket |
| 5 | front door |
| 6 | condenser |
| 7 | control panel |
| 8 | rear cover |
| 9 | frame/flange |
| 10 | LED lamp |
| 10a | air flow |
| 11 | elastic sleeve |
| 12 | projection |
| 12a | nose |
| 13 | optical window |
| 14 | loading opening |
| 15 | lamp case |
| 16 | board/PCB |
| 17 | base plate |
| 18 | cantilever plate |
| 19 | LED component |
| 20 | chassis |
| 21 | coupler plug |
| 22 | wire |
| 30 | lamp socket |
| 32 | via |
| 34 | tongue |
| 36 | snap hook |
| 38 | alignment pin |
| 40 | guide lug |
| 42 | latch hook |
| 44 | slot |
| 46 | groove |
| 48 | collar |
| 50 | cut-out |
| 52 | trace |
| 60 | mold head |
| 62 | SMD component |
| α | tilt angle |
| β | surface angle |

The invention claimed is:

1. A laundry machine comprising:

a body having a laundry loading opening;

a drum, rotatably supported in the body; and a drum illumination device for illuminating the interior of the drum;

wherein, the drum illumination device comprises a printed circuit board and at least one semiconductor or plasma light emitting element arranged on the PCB, the PCB comprising a base portion and an inclined portion which is inclined relative to the base portion.

2. A laundry machine according to claim 1, wherein the PCB comprises a metal substrate.

3. A laundry machine according to claim 2, wherein an insulating layer is formed on one or both surfaces of the metal substrate, wherein the insulating layer covers all or at least a portion of the one or both surfaces, and wherein at least one conductive trace is formed on the insulating layer.

4. A laundry machine according to claim 3, wherein the PCB comprises a base portion and an inclined portion which is inclined relative to the base portion.

5. A laundry machine according to claim 1, wherein the base portion of the PCB comprises a connector section at a region of the base portion which is opposite to the inclined portion, and/or wherein the at least one light emitting element is arranged on the outward facing surface of the inclined portion of the PCB.

6. A laundry machine according to claim 5, wherein the PCB is mounted in a supporting body.

7. A laundry machine according to claim 1, wherein the PCB is mounted in a supporting body.

8. A laundry machine according to claim 7, wherein the supporting body comprises a mounting member adapted to mount and/or snap-fit and/or align an optic case element and/or an electrical connector.

9. A laundry machine according to claim 7, wherein the drum illumination device comprises an optic case element designed to cover the at least one light emitting element and to receive at least a portion of the PCB and/or the supporting body, the optic case element comprising an optical window facing the at least one light emitting element.

10. A laundry machine according to claim 9, wherein the optic case element comprises an internal mounting means adapted to cooperate with a mounting member of the supporting body to provide a mechanical connection and/or alignment between the optic case element and the supporting body.

11. A laundry machine according to claim 1, wherein the drum illumination device comprises an optic case element designed to cover the at least one light emitting element and to receive at least a portion of the PCB, the optic case element comprising an optical window facing the at least one light emitting element.

12. A laundry machine according to claim 11, wherein the optic case element comprises an external mounting member adapted to cooperate with a receiving mount arranged in proximity to the drum, said receiving mount having an opening facing towards the drum interior.

13. A laundry machine according to claim 11, wherein a sealing element is arranged at the optic case element adapted to provide a sealing between the optic case element and a receiving mount for receiving the drum illumination device.

14. A laundry machine according to claim 1, wherein the drum illumination device comprises at least one alignment element adapted to align the drum illumination device to a predetermined position in a receiving mount for receiving the drum illumination device.

15. A laundry machine according to claim 1, wherein the drum illumination device comprises a fixing member adapted to fix the drum illumination device in a predefined position in a receiving mount for receiving the drum illumination device.

16. A laundry machine according to claim 1, comprising a frame arranged between the front end of the drum and the laundry loading opening, wherein said receiving mount is arranged at or in the frame.

17. A laundry machine according to claim 16, wherein, when the drum illumination device is mounted in the receiving mount, the front face of the drum illumination device is flush or essentially flush with a surface area of the inner side of the frame surrounding the front face of the drum illumination device.

18. A laundry machine according to claim 1, wherein the PCB is mounted in a supporting body.

19. A laundry machine comprising:

a body having a laundry loading opening;

a drum, rotatably supported in the body; and a drum illumination device for illuminating the interior of the drum and comprising:

a printed circuit board and at least one semiconductor or plasma light emitting element arranged on the PCB;

an optic case element designed to cover the at least one light emitting element and to receive at least a portion of the PCB, the optic case element comprising an optical window facing the at least one light emitting element; and a sealing element arranged at the optic case element and adapted to provide a sealing between the optic case element and a receiving mount for receiving the drum illumination device, wherein the sealing element has a sleeve section with a front face that surrounds the outer surface of the optical window of the optic case element, and wherein the sealing element is integrally cast or over-injected to the outer surface of the optic case element.

* * * * *